United States Patent [19]

Poling et al.

[11] 4,090,867

[45] May 23, 1978

[54] FLOTATION OF NON-SULPHIDE COPPER ORES

[75] Inventors: George W. Poling, Vancouver, Canada; Jorge E. Rosas, Santiago, Chile

[73] Assignee: Canadian Patents & Development Limited, Ottawa, Canada

[21] Appl. No.: 681,065

[22] Filed: Apr. 28, 1976 (Under 37 CFR 1.47)

[30] Foreign Application Priority Data

Apr. 30, 1975 Canada ..... 225926

[51] Int. Cl.[2] ..... B03D 1/02; B22B 15/00

[52] U.S. Cl. ..... 75/2; 75/117; 209/166; 423/26

[58] Field of Search ..... 75/1, 2, 97 R, 108, 75/117; 209/166, 167, 171; 423/26, 37

[56] References Cited

U.S. PATENT DOCUMENTS

| | | | |
|---|---|---|---|
| 1,094,760 | 4/1914 | Terry, Jr. | 209/166 |
| 1,102,873 | 7/1914 | Chapman et al. | 209/166 |
| 1,716,104 | 6/1929 | Bolton | 209/167 |
| 1,850,991 | 3/1932 | Trotter | 209/166 |
| 1,916,196 | 7/1933 | Ayer et al. | 209/166 |
| 1,950,537 | 3/1934 | Barthelemy et al. | 209/167 |
| 2,180,926 | 11/1939 | Jayne et al. | 209/166 |
| 2,383,106 | 8/1945 | Booth | 209/166 |
| 2,432,456 | 12/1947 | Sproule et al. | 209/167 |
| 3,883,421 | 5/1975 | Cutting et al. | 75/2 |

OTHER PUBLICATIONS

Alien Property Custodian Document No. 414,979, 5/18/43, to August Götte.

*Primary Examiner*—L. Dewayne Rutledge
*Assistant Examiner*—Michael L. Lewis
*Attorney, Agent, or Firm*—Alan A. Thomson

[57] ABSTRACT

Flotation of a variety of non-sulphide and mixed sulphide plus non-sulphide copper ores is disclosed. Stabilization of non-sulphide copper mineral surfaces by sulphidization is initially required and a selective complexing agent able to complex with the copper sulphide surface is then added as conditioner. Diphenylguanidine proved to be a highly selective and fast acting surface conditioner which converted both sulphide and sulphidized copper minerals to an oleophilic condition. Addition of relatively small amounts of emulsified, non-polar oil completed the selective conversion of copper minerals to strongly hydrophobic and floatable condition. Favorable results have been obtained on a series of ores ranging from low grade malachite-chal-copyrite ores to high grade cuprite-malachite-chalcocite and brochantite ores.

8 Claims, No Drawings

FLOTATION OF NON-SULPHIDE COPPER ORES

INTRODUCTION AND PRIOR ART

Flotation of non-sulphide copper minerals and mixed sulphide plus non-sulphide copper minerals presents many practical problems. Instability of the non-sulphide copper mineral/solution interface due to chemical dissolution or mechanical attrition contributes to lack of adhesion of collector coatings and unstable particle-bubble agglomerates. The resulting presence of significant copper in solution can also lead to undesirable activation of gangue minerals. Both the dissolution and attrition-produced slimes cause excessive copper-collector consumption. Porosity of some non-sulphide copper minerals also accentuates this latter reagent cost factor. Frequent presence of interfering gangue minerals such as clays and limonite, plus calcium and magnesium carbonates further complicates achieving acceptable copper concentrate grades and recoveries. Selective dispersion and depression of such gangue minerals is an important requirement of most non-sulphide copper flotation schemes.

Two basic flotation procedures have been used commercially to treat non-sulphide copper ores (mainly malachite containing ores). The first has used fatty acid collectors, such as Palm kernel oil, which contains oleic acid. These collectors can provide high copper recoveries but are relatively non-selective, particularly in the presence of calcium or magnesium gangue minerals. The second has involved sulphidization usually followed by addition of a xanthate-type collector. This system is far more selective but it can be both costly in terms of reagents used and difficult to control for high recovery of coarse and fine sulphide and non-sulphide copper mineral particles. For example, the presence of excess $SH^-$ ions can depress the flotation of sulphidized copper and/or copper sulphides in mixed sulphide-non sulphide ores. Non-sulphide copper fines tend to consume too much $SH^-$ and leave the coarser particles with insufficient. Multistage addition of sulphidizing agent is used in an attempt to prevent this and to economize on $SH^-$ consumption.

PRESENT INVENTION

This disclosure describes procedures which we have proven to be successful in the flotation of non-sulphide and mixed sulphide non-sulphide copper ores. Flotation tests on a variety of minerals are reported herein. This invention involves sulphidization of non-sulphide copper mineral surfaces; stabilization of the non-sulphide sulphidized copper mineral surfaces by reaction with complexing agents selective for the copper sulphide surfaces; addition of a non-polar oil emulsion (to enhance the stability of bubble/mineral aggregates, to assist the recovery of middling particles and to reduce the chance of residual $SH^-$ ions depressing the floatabilities of sulphide and sulphidized copper surfaces); and flotation of the copper values.

The present process comprises the following steps:

(a) stabilization of non-sulphide copper mineral surfaces by sulphidization, (b) reaction of sulphide and sulphidized copper mineral surfaces with a complexing agent selective for the copper sulphide surfaces to render the surfaces oleophilic and weakly hydrophobic, (c) adding an emulsion of a non-polar oil to render said oleophilic surfaces strongly hydrophobic, and (d) concentrating by flotation the hydrophobic copper minerals, and recovering the concentrate.

Preferably, the process includes firstly, selective dispersion of gangue minerals such as calcitic and siliceous minerals, some of which often occur as slime fractions; secondly, stabilization and conditioning with a specific complexing agent selective for the copper sulphide surfaces such as diphenylguanidine $[(C_6H_5NH)_2C{:}NH]$ (the diphenylguanidine reacts at both sulphide and sulphidized non-sulphide copper mineral surfaces to render them selectively oleophilic and weakly hydrophobic); thirdly, selectively rendering oleophilic mineral particles strongly hydrophobic and floatable by adsorption of non-polar oil dispersed through the pulp as a fine emulsion; and fourthly, flotation concentration of the hydrophobic copper minerals (preferably after adding conventional frothers such as pine oil, aliphatic alcohols or polyalkoxyparaffins).

Several copper complexing agents including: benzotriazole (BTA); toluyl triazole (TTA); mercaptobenzothiazole (MTA) and diphenylguanidine (DPG) were initially tested as surface conditioners for this system. Tests indicated that diphenylguanidine was slightly more selective and provided relatively rapid flotation rates and high copper recoveries. Thus, this preferred reagent was selected for detailed tests but other analogous complexing agents selective for the copper sulphide surfaces would be operative. Diphenylguanidine has been used for many years as both collector and frother in the INCO copper-nickel matte separation process.

Sulphidization and conditioner interactions with malachite and brochantite were evaluated using adsorption isotherms, contact angles, electrophoretic mobilities, infrared spectroscopy and scanning electron miroscopy in addition to standard flotation tests.

Sulphidization followed by reaction of a complexing agent such as DPG stabilized the non-sulphide sulphidized copper mineral surfaces through reduction of solubility and production of more abrasion resistant "skins." These conditioner-coated surfaces (including any natural copper sulphide surfaces) were rendered only weakly hydrophobic but strongly oleophilic. Non-polar oil, added as an emulsion, coated these copper-containing surfaces selectively and converted them to strongly hydrophobic and floatable condition. This relatively inexpensive flotation system also enhanced the floatabilities of middling particles. In addition, the presence of the oil ensured continuing floatability of copper sulphides even with slight excesses of residual $SH^-$ ions or oxidation products thereof. Thus ores containing mixtures of primary and secondary sulphides such as: $CuFeS_2$, $Cu_2S$, $CuS$, as well as non-sulphides such as: $Cu_2O$, $CuO$, $Cu_2(OH)_2CO_3$, $Cu_3(OH)_2(CO_3)_2$, $Cu_4(OH)_6SO_4$ have been concentrated successfully using this procedure.

The process has provided rapid rates of flotation producing relatively high grade concentrates at higher copper recoveries than achieved in comparison tests using more conventional sulphidization plus xanthate collector techniques. In addition, consumption of sulphidizing agent such as NaSH, or $Na_2S$ has often been considerably lower in our process. Use of a *two-component conditioner-collector system such as diphenylguanidine plus non-polar oil offers several advantages.* Consumption of a relatively expensive reagent such as the diphenylguanidine is minimized by utilizing inexpensive non-polar oil to enhance the "collector action."

Strongly adherent and highly hydrophobic coatings of copper-diphenylguanidine complex plus adsorbed "oil" make flotation of both sulphide and sulphidized copper relatively insensitive to the potential depressant action of residual $SH^-$ ions (sulphidizing agent). This conditioner-collector system thus enables mixed sulphide plus non-sulphide copper minerals to be floated concurrently and rapidly with high recoveries of both.

EXAMPLES AND PREFERRED EMBODIMENTS

Materials

1. Minerals (A) Brochantite samples were obtained both from Mexico and from Chile. Pieces were ground dry and a −100 +200 mesh fraction purified further using a magnetic separator. The paramagnetic brochantite concentrate assayed 54% Cu (Theoretical $Cu_4(OH)_6SO_4$ = 56.0% Cu). Main impurities were quartz and limonite.

(B) Malachite specimens were obtained from Arizona. After high intensity dry magnetic separation, it assayed 53% Cu (Theoretical $Cu_2(OH)_2CO_3$ = 57.4% Cu). Quartz and tenorite were the major impurities.

2. Ores

Synthetic Ores were prepared using 1 part by weight of the 100/200 mesh brochantite and/or malachite together with 50 parts of artificial gangue. This gangue normally consisted of:

70% $CaCO_3$ of size 41.0% −100 +200 mesh and 59.0% −200 mesh 17% $SiO_2$ of size 33.0% −100 +200 mesh and 67.0% −200 mesh 13% Clay of size 100% −5μm.

Natural ores for flotation testing have been obtained from within British Columbia, from Chile and from South West Africa. A high grade brochantite ore (designated C-1) was obtained from Chile. This ore assayed 7.0% total Cu with 6.9% non-sulphide Cu mostly as brochantite. Minor impurities included chrysocolla and chalcocite. Quartz and orthoclase comprised the majority of the gangue with minor sericite, barite and calcite.

Medium and high grade mixed sulphide-non sulphide copper ores (designated C-2 and C-3 respectively) were obtained from South West Africa. Ore C-2 assayed 1% Cu which was mostly as malachite (≈90% of the Cu) with minor cuprite and chalcocite. The gangue was mainly calcite with some limonite, clay and silica. Ore C-3 assayed 4.3% total Cu with 3.4% non-sulphide Cu. The sulphide Cu was mainly chalcocite; cuprite plus malachite were the major non-sulphide Cu minerals with minor native copper. Liberation of these minerals was nearly complete at 48 mesh.

A "mixed" low grade malachite-chalcopyrite, chalcocite, bornite ore (designated C-4) from British Columbia was also tested. This ore contained 0.7% total Cu of which 0.5% Cu was non-sulphide. The gangue consisted principally of feldspar and secondary silicates. The copper minerals were finely disseminated throughout this ore and liberation required grinding finer than approximately 50μm.

3. Reagents for Examples (A) Gangue dispersants/depressants — Cataflot P. 39 a low molecular weight acrylate polymer (supplied by Pierrefitte Auby in France); and sodium meta-silicate (called Metso Anhydrous Silicate supplied by the National Silicate Co.).

(B) Sulphidizing agent — sodium hydrosulphide flakes.

(C) Copper-complexing conditioners — diphenylguanidine (DPG); Benzotriazole; Toluyl triazole; and mercaptobenzothiazole.

(D) Non-polar oil emulsions: Sunflex 110 of 0.85 S.G. and 20.5 c.s. viscosity; vapor oil of 0.840 S.G. and 22.0 c.s. viscosity and odorless kerosene of 0.800 S.G. and 1.3 c.s. viscosity. Any non-polar hydrophobic oil would be operative. These oils were prepared as ultrasonically dispersed emulsions of 1% oil by weight in distilled water using the following surfactants:

(i) commercial Artic Syntex L which consists of sulphated coco-monoglyceride plus $Na_2SO_4$;

(ii) Sodium lauryl sulphate of reagent grade;

(iii) Cetyl trimethyl ammonium bromide (CTAB) of reagent grade. Emulsifier was added as 5% of the weight of oil or 0.05% of the oil in water emulsion.

(E) Frother — pine oil was normally used but others including synthetic frothers could be substituted effectively.

FLOTATION STUDIES

Synthetic Ores were floated using a modified Denver Model D laboratory cell. The flotation procedure was as follows: 1 gram of the malachite or brochantite plus 50 grams of the artificial gangue were mixed to provide an ore assaying approximately 1.0% Cu. This was added to the cell with 300 ml of tap water, the pH was adjusted to the desired value, gangue dispersants were added and the pulp conditioned for 1 minute. Sulphidizer was then added if desired and conditioning continued for 1 minute. Next the complexing conditioner was added and after another minute the oil emulsion and frother were added and the pulp conditioned 2 more minutes. Copper concentrate was collected during 3 minutes of flotation using approximately 6 liters of air.

Natural Ores were crushed, ground wet at 50% solids in a laboratory rod mill and floated in 500 g size laboratory flotation cells. The reagentizing procedure was similar to that described above except that: lime and sometimes gangue dispersants were added to the grinding mill; sodium hydrosulphide, DPG and emulsified oil were sometimes added in sequence while conditioning 6 to 8 minutes and sometimes together to simplify the process. Flotation utilized an aeration rate of ≈10 lpm. A first concentrate was collected after 2 to 3 minutes then more sulphidizer was added and a second concentrate collected after 2 or 3 more minutes. This operation was repeated until no more valuable mineral was floated. The various concentrates were filtered, dried, weighed and assayed for both sulphide and non-sulphide copper contents to calculate metallurgical balances. Rougher concentrates were sometimes "cleaned" in a 200 g cell.

THE NATURES OF SULPHIDIZED AND/OR CONDITIONER COATING ON BROCHANTITE

Although the DPG reacted at or near the brochantite surface to form a $Cu(DPG)_2SO_4$ complex, no stable film was formed on the mineral. Instead the Cu-DPG complex was displaced into the solution, perhaps by undermining due to continuing dissolution of the brochantite. In fact, DPG used alone can be considered a "corrosive agent" for brochantite. The more concentrated was the DPG solution, the higher was the concentration of copper found in the solution.

Lack of persistence of the Cu-DPG complex at the surface of pure brochantite was substantiated by the scanning electron micrographs. In spite of the consumption of DPG equivalent to many monolayers, the surface of the DPG treated brochantite remainded almost identical to that of the untreated mineral. On the other hand, following sulphidization which resulted in readily discernible CuS crystallites, DPG reacted to form crystallites of $Cu(DPG)_2SO_4$. Use of DPG alone as both a "surface-stabilizing-agent" and a collector did not appear feasible.

Sulphidization followed by adsorption of DPG both stabilized the surface of the brochantite and converted it to a weakly hydrophobic but strongly oleophilic condition. Data indicates that DPG adsorbed faster on sulphidized brochantite than on the pure mineral.

Contact angle data shown in Table 1 indicated the effects of sulphidization and adsorption of DPG resulted in contact angles of approximately 25°. Other results indicated that this degree of hydrophobicity was too low for effective flotation. Addition of emulsified oil however resulted in strongly hydrophobic surfaces ($\theta = 75°$ in Table 1) on the sulphidized-DPG treated brochantite. Thus the copper minerals were first stabilized mainly by sulphidization, then rendered selectively oleophilic by reaction with DPG, then converted to a hydrophobic and floatable condition by addition of the emulsified oil. Although these surface chemical studies were conducted mainly on brochantite, lab scale flotation studies indicated that malachite responded in a very similar fashion.

From these initial tests on malachite and brochantite, sulphidization, treatment by DPG followed by a non-polar oil appeared most promising. Poor flotation was for example the result when DPG alone was used after sulphidization (no oil was used) or when no sulphidization was used. Tests also indicated that chalcopyrite responded well to the above three-component collector system.

ORE FLOTATION

1. Influence of Composition of Gangue:

Flotation tests conducted on both synthetic malachite- and brochantite-containing ores indicated significant decrease in selectivity with higher limestone contents in the artificial gangues. Thus depression of calcitic gangues is often more crucial to selective flotation than the depression of silica.

2. Gangue Dispersants and Depressants:

On floating the synthetic brochantite-calcitic gangue ore increasing additions of Cataflot P. 39, acrylate polymers (as dispersants and depressants for carbonate gangues) improved both concentrate grades and recoveries. On synthetic ores an addition of about 150 g/t of Cataflot P. 39 was selected to provide reasonable dispersion. Sodium silicate and lime are also useful for this purpose.

3. Conditioner-Collector System:

Results of floating Cataflot P. 39-dispersed, synthetic brochantite ore using different collector systems over a wide range of pHs gave near zero floatabilities with DPG alone confirming the instability of the Cu mineral-DPG coating. Prior sulphidization did slightly improve mineral stability and floatability using the DPG collector. However, addition of 100 g/t of emulsified oil to this system provided excellent recoveries particularly over the pH range of 9.5 to 10.5. A suitable concentration range for the oil would be about 50 - 500 g/t.

Optimum level of DPG addition is indicated to be about 60 g/t for the synthetic 1% Cu-brochantite ore. This was equivalent to an initial concentration of $4.7 \times 10^{-5}$M DPG. This molarity corresponds closely to the equilibrium concentration of DPG which produced near-limiting growth of the Cu-DPG coating. A suitable range in practice would be from about 20 to 120 g/t. Results also indicated the near-zero floatability of sulphidized, oil-exposed, brochantite in absence of the DPG collector component.

Effects of varying additions of hydrosulphide on synthetic ore flotation were observed. These results indicate that addition of a small amount of $NaSH \cdot H_2O$ (i.e., 50 g/t) caused the floatability of brochantite to increase rapidly from near zero in the presence of either DPG + oil, or DPG alone. Comparisons of Cu recoveries with and without oil additions further confirms the importance of oil as a non-polar component in this collector system. Data suggests that 100 g/t of $NaSH \cdot H_2O$ was near the optimum level for this synthetic ore.

Effects of using different oils as components in the collector system are shown in Table 2. All three oils tested (kerosene, vapor oil, Sunflex 110) were emulsified with Artic Syntex L as emulsifying agent. Vapor oil and Sunflex 110 were similar in physical properties and, as expected, produced similar concentrate grades and recoveries although the rate of flotation using Sunflex 110 was slightly higher. Their testing was performed to demonstrate that choice of a particular non-polar reagent for the collector system is not critical. Use of kerosene with much lower viscosity (and lower average molecular weight or chain length) resulted in both lower recoveries and lower grades. Thus use of such a "light" non-polar oil as collector component is not preferred.

Tests were also conducted with alternative emulsifying agents. Pure sodium lauryl sulphate produced emulsions of similar quality to those stabilized by Artic Syntex L. Sodium lignin sulphonate produce slightly less stable emulsions. Positively charged emulsion oil droplets were produced by using cetyl trimethyl ammonium bromide as emulsifier. Comparisons of results obtained using CTAB and the Syntex L emulsifiers on the three oils are presented in Table 3. Although reduced selectivity of collection by "oil" and flotation was expected, this was not shown by results of floating the synthetic brochantite ore. These results support the previous evidence that surface charges of the various species did not play significant roles in the selectivity of adsorption or adhesion of the non-polar collector component.

NATURAL ORE FLOTATION

In each of the tests listed, 200 g/t sodium metasilicate was added to enhance depression of the silicate gangue minerals. In general, higher additions of Cataflot P. 39 alone would have produced similar results but at a substantially increased reagent cost. Lime was routinely used as a pH modifier and pyrite depressant. In absence of significant pyrite, $Na_2CO_3$ would have had advantages in aiding dispersion of the gangue minerals. Table 4 summarizes the test conditions employed on each ore. While total additions of sulphidizer are shown, this reagent was usually stage-wise added both during preliminary conditioning and as the batch flotations progressed. Although neither the test procedures nor levels of reagent additions were optimized, the conditions shown in Table 4 produced the best results of a series of several tests on each ore. Results were reproducible to within $\approx 2\%$ in both grades and recoveries in attempts at identical test procedures.

Results of roughing, scavenging and single stage cleaning of rougher flotation concentrates on the Chilean high grade brochantite ore are shown in Table 5. The rougher concentrate recovering 80.9% of the total copper was collected after adding NaSH in two stages using 375 and 250 g/t respectively. A third addition of 190 g/t NaSH yielded the scavenger concentrate which increased total copper recovery to 84.9%. Most of the non-floating copper losses occurred in the coarser fractions. Thus more attention to grinding and classifying operations would be expected to have increased copper recoveries.

The cleaner concentrate was collected by refloating the rougher concentrate at reduced pulp density but without further reagent additions. The 43.2% copper cleaner concentrate represented ≈93% of the copper contained in the initial rougher concentrate. Results of flotation tests using a sulphidization-xanthate collector system on similar samples of ore, from the same ore body have been reported recently [MILLAN, A., and co-workers, "Flotation of tailings containing brochantite," *First South American Congress of Mineral Processing,* Santiago (1973) to be published]. This procedure succeeded in recovering up to 75.5% of the copper in a rougher concentrate assaying 37% Cu. Consumptions of amyl xanthate and sodium sulphide were 200 g/t and 2300 g/t respectively. Total flotation time was 15 minutes. The present invention flotation procedure outlined in Table 4 thus has provided both higher copper recovery and higher flotation rate. Total reagent cost for the reagent additions shown in Table 4, C-1 would amount to approximately $0.70/ton (August, 1974) as compared to over $1.00/ton for the conventional reagent scheme cited above.

Typical results obtained in floating the South-West African malachite-chalcocite-cuprite ore under the conditions indicated in Table 4 are shown in Table 6. Considering the high content of clay slimes and the relatively low head grade of this ore, recoveries of over 80% were encouraging. Since most of the copper lost appeared to be in coarse malachite middlings, it is likely that finer grinding could have improved the recovery.

A large number of tests were conducted on the cuprite-chalcocite-malachite ore. Although liberation of valuable minerals was not a problem, medium-fine grinding (80% - 200 mesh) was necessary to enable efficient flotation of the high specific gravity minerals, chalcocite and cuprite. Results of one of the better tests are shown in Table 7.

The first rougher concentrate assayed 48.0% Cu total and 37.9% non-sulphide Cu with recoveries of 84.2% and 81.4% respectively. This concentrate was collected after adding 500 g/t NaSH and floating for 2 minutes only. The second rougher concentrate consisting mainly of malachite and representing nearly 7% of the total copper was collected in an additional 2 minutes flotation time after adding 325 g/t of $NaSH{\cdot}H_2O$. Combining both concentrates from 4 minutes of flotation represented recovery of 91.5% of the total copper (93% of the N.S.Cu) at a concentrate grade of 43.7% Cu. Three more staged additions of 250 g/t of sulphidizer produced a third rougher or scavenger concentrate assaying 6.65% CuT (6.2% N.S.Cu) and containing ≈2% of the total copper. Total copper recovery was thus increased to 93.5%. Most of the copper remaining in the tailings at this stage (after 10 minutes total flotation time) consisted of coarse malachite and malachite middlings.

High recoveries and rapid rates of flotation characterized the above procedure. For comparison, allyl n-amyl xanthate was substituted for DPG in the reagent scheme shown in Table 4, C-3. Flotation was much slower with times of 30 to 40 minutes required to obtain recoveries in excess of 90%. Concentrate grades using this reagent were also much lower than when using DPG.

Chalcocite and cuprite were observed to float much faster than malachite. Thus with time the color of the froth changed gradually from black to red to bright green in a rather spectacular display of mineral specific flotation rate constants. Chalcocite was invariably recovered almost completely in these tests, even in the presence of relatively high residual $SH^-$ ion concentrations. Thus the DPG-non-polar oil collector combination was able to resist displacement and hydrophilic effects of absorbing $SH^-$ ions on this sulphide mineral.

Typical results of several tests on the British Columbian low grade malachite-chalcopyrite ore are presented in Table 8. As indicated by the test conditions of column C-4 in Table 4, relatively low additions of both sulphidizer (160 g/t) and DPG collector (50 g/t) were used in this test. Total reagent cost would have been approximately $0.30/ton. Optimization of both grinding and reagentizing are necessary in order to improve on the 70% total copper recovery obtained. Since all of the copper remaining in the tailings was present as malachite, increased dosages of sulphidizer would be expected to bring some improvement.

Substitution of xanthate and thionocarbamate (Z-200) as collector did provide similar copper recoveries but at the expense of much higher doses of sulphidizer (1750 g/t) and much longer conditioning and flotation times (16 and 15 minutes each respectively).

Use of relatively inexpensive oil as a collector component economizes in consumption of the more expensive conditioner component. Adsorption of the oil phase occurs onto both copper sulphide and sulphidized copper mineral surfaces which has been found to reduce their sensitivity to depression by residual $SH^-$ ions present in the pulp. This appears to be one of the main reasons that both sulphide and non-sulphide copper minerals can be floated together using this flotation procedure. High rates of flotation of both sulphide and most non-sulphide copper minerals are another characteristic of this invention.

Reagents such as pH modifiers and gangue dispersants can be added to the grinding mills. Sulphidizer, conditioner, oil emulsion and frother can be added at a conditioner stage preceding flotation. Staged addition of sulphidizer along the roughing-scavenging bank of cells appears beneficial to improve recovery and economize on sulphidizer consumption.

Table 1

| Contact Angle Measurements | | |
|---|---|---|
| Solid | Liquid at pH 9.5 | Contact angle |
| Brochantite | distilled water | no bubble contact |
| Brochantite treated with DPG | saturated solution of DPG | <10° |
| Sulphidized brochantite treated with DPG | saturated solution of DPG | ~25° |
| Sulphidized brochantite treated with DPG and emulsified oil | distilled water | ~75° |

Table 8

Flotation of a malachite-chalcopyrite containing ore (C-4)

| Product | Weight % | Assays % Tot Cu | Assays % N.S. Cu | Distribution Total Cu | Distribution N.S. Cu |
|---|---|---|---|---|---|
| Cleaner conc | 1.78 | 23.5 | 11.5 | 60.96 | 43.52 |
| Cleaner tail | 4.39 | 1.4 | 1.35 | 8.96 | 12.61 |
| Rougher conc | 6.17 | 7.78 | 4.28 | 69.92 | 56.13 |
| Tailing | 93.83 | .22 | .22 | 30.08 | 43.87 |
| Head | 100.00 | .69 | .47 | — | — |

Table 2

Effects of different oils on emulsion flotation

| Dosage | Oil: Kerosene Grade | Kerosene Rec | Vapour Oil Grade | Vapour Oil Rec | Sunflex 110 Grade | Sunflex 110 Rec |
|---|---|---|---|---|---|---|
| 100 g/t | 12.8 | 90.6 | 18.0 | 98.0 | 18.5 | 98.9 |
| 200 g/t | 15.2 | 94.4 | 19.9 | 98.6 | 20.0 | 98.9 |
| 400 g/t | 17.8 | 95.6 | 19.0 | 97.3 | 19.5 | 98.9 |

Grade: concentrate grade. % Cu
Rec: Recovery . %

Table 3

Effects of anionic and cationic emulsifiers on flotation

| Oil (100 g/t) | Surfactant: Syntec L Grade | Syntec L Rec | CTAB Grade | CTAB Rec |
|---|---|---|---|---|
| Kerosine | 12.8 | 90.6 | 19.5 | 96.4 |
| Vapour Oil | 18.0 | 98.0 | 21.6 | 97.4 |
| Sunflex 110 | 18.5 | 98.9 | 22.5 | 98.2 |

Grade: Concencentrate grade % Cu
Rec.: Recovery %

Table 6

Typical metallurgical balance from flotation of a malachite-containing ore (C-2)

| Product | Weight % | Grade % T Cu | Recovery % Direct | Recovery % Cumulat. |
|---|---|---|---|---|
| Cleaner conc | 2.10 | 39.5 | 78.25 | 78.25 |
| Cleaner tail | 4.02 | .83 | 3.15 | 81.4 |
| Rougher con | 6.12 | 14.10 | 81.40 | — |
| Rougher tail | 93.88 | .21 | 18.60 | 100.00 |
| Calc. Head | 100.00 | 1.06 | 100.00 | |

Table 7

Flotation of a cuprite-malachite containing ore. (C-3)

| PRODUCT | Weight % | Assays % Tot Cu | Assays % N.S.Cu | Distribution % TOTAL Cu | Distribution % N.S. Cu |
|---|---|---|---|---|---|
| 1st CONC. | 7.72 | 48.0 | 37.9 | 84.23 | 81.40 |
| 2nd CONC. | 1.48 | 21.7 | 21.6 | 7.30 | 8.89 |
| 3rd CONC. | 1.30 | 6.65 | 6.2 | 1.96 | 2.24 |
| TOTAL CONC. | 10.50 | 39.2 | 31.7 | 93.49 | 92.53 |
| TAILING | 89.50 | .32 | .30 | 6.51 | 7.47 |
| CALC. HEAD | 100.00 | 4.40 | 3.60 | 100.00 | 100.00 |

We claim:

1. A process for beneficiation of copper ores which are at least partially in non-sulphide form and which include one or more of the copper minerals malachite, chalcopyrite, cuprite, brochantite, chalcocite and bornite, by flotation, comprising Table 4

Tests Conditions on Different Ores

| Reagents and Flotation Conditions | C-1 High grade brochantite ore 7.0% T Cu 6.9% N.S. Cu | C-2 Malachite chalcocite cuprite ore 1.0% T Cu 0.9% N.S. Cu | C-3 High grade malachite chalcocite, cuprite ore 4.3% T Cu 3.4% N.S. Cu | C-4 Low grade malachite chalcopyrite ore 0.7% T Cu 0.5 N.S. Cu |
|---|---|---|---|---|
| Na Silicate g/t | 200 | 200 | 200 | 200 |
| Cataflot P-39 g/t | 60 | 100 | 100 | 60 |
| DPG g/t | 120 | 80 | 100 | 50 |
| Emulsified oil g/t | 400 | 150 | 200 | 200 |
| Frother g/t | 30 | 20 | 20 | 20 |
| NaSH . $H_2O$ g/t | 815 | 300 | 1625 | 160 |
| pH | 9.5 - 10.0 | 9.5 - 10.0 | 9.6 - 10.0 | 9.5 - 10.0 |
| Conditioning time, min | 5 | 5 | 5 | 3 |
| Flotation time, min | 7 | 5 | 10 | 4 |
| Pulp density, % sol. | 10 | 30 | 30 | 30 |
| Mesh of grind, % - 200# | 82 | 72 | 80 | 75 |

T Cu = Total Copper
N.S. Cu = Non sulphide copper

Table 5

Typical metallurgical balance from flotation of a brochantite containing ore (C-1)

| Product | Weight % | Assay % T Cu | Distribution Direct | Distribution Cumul. |
|---|---|---|---|---|
| Cleaner conc | 12.36 | 43.2 | 75.12 | 75.12 |
| Cleaner tail. | 3.77 | 10.9 | 5.78 | 80.90 |
| Rougher conc. | 16.13 | 35.7 | 80.90 | — |
| Scavang. conc. | 4.37 | 6.5 | 4.00 | 84.90 |
| Rougher tail | 79.50 | 1.35 | 15.10 | 100.00 |
| Calc. Head | 100.00 | 7.10 | 100.00 | — |

(a) sulphidizing of non-sulphide copper mineral surfaces to stabilize said surfaces;

(b) reacting the sulphide and sulphidized copper mineral surfaces with a diphenylguanidine complexing agent selective for the copper sulphide surfaces the amount of complexing agent being only added to react with the copper sulphide to render said surfaces oleophilic and weakly hydrophobic, (c) adding an emulsion of a non-polar oil which is more viscous than kerosene and hydrophobic to render said oleophilic surfaces strongly hydrophobic, and (d) concentrating by flotation the hydrophobic copper sulphide minerals away from the non-floated gangue, and recovering the concentrate.

2. The process of claim 1 wherein the gangue minerals are selectively dispersed and depressed by addition of selected depressing agents therefor.

3. The process of claim 1 wherein the sulphide and sulphidized minerals are reacted with diphenylguanidine in step (b) in amounts of about 20 to 120 grams/ton of ore.

4. The process of claim 1 wherein at least one of the following sulphides: $CuFeS_2$, $Cu_2S$ and CuS is present, as well as at least one of the non-sulphides $Cu_2O$, CuO, $Cu_2(OH)_2CO_3$, $CU_3(OH)_2(CO_3)_2$ and $CU_4(OH)_6SO_4$.

5. The process of claim 3 wherein the diphenylguanidine is present in from about 50 to 80 grams/ton.

6. The process of claim 1 wherein the non-polar oil is present in from about 50 to 500 grams/ton.

7. The process of claim 1 wherein the flotation step (d) is carried out at pH about 9.5 to 10.5.

8. The process of claim 2 wherein the gangue is depressed by addition of one of: acrylate polymers, sodium silicate and lime.

* * * * *